United States Patent [19]

Leitner

[11] 4,328,626

[45] May 11, 1982

[54] APPARATUS FOR DRYING A FIBROUS WEB

[75] Inventor: Franz Leitner, Grimmenstein, Austria

[73] Assignee: H. Walli Gesellschaft m.b.H. Papier- und Zellstoffwattefabrik, Thomasberg, Austria

[21] Appl. No.: 130,255

[22] Filed: Mar. 14, 1980

[30] Foreign Application Priority Data

Feb. 3, 1978 [AT] Austria ..... 779/78

[51] Int. Cl.[3] ..... F26B 11/02; B65H 17/30

[52] U.S. Cl. ..... 34/115; 34/155; 226/95

[58] Field of Search ..... 226/95, 97, 93, 7; 34/110, 115, 152, 156, 155; 15/306 A

[56] References Cited

U.S. PATENT DOCUMENTS

| | | | |
|---|---|---|---|
| 3,118,582 | 1/1964 | Rapoza | 226/95 |
| 3,142,428 | 7/1964 | Faeber | 226/95 |
| 3,276,140 | 10/1966 | Walser et al. | 34/110 |
| 3,587,962 | 6/1971 | Herzhoff et al. | 226/95 |
| 4,251,927 | 2/1981 | Luthi | 34/110 |

FOREIGN PATENT DOCUMENTS

| | | | |
|---|---|---|---|
| 2000436 | 7/1971 | Fed. Rep. of Germany | 34/110 |
| 2901471 | 8/1979 | Fed. Rep. of Germany | 34/110 |
| 1586699 | 2/1970 | France | 34/110 |
| 849797 | 9/1960 | United Kingdom | 226/95 |

*Primary Examiner*—Stanley N. Gilreath
*Attorney, Agent, or Firm*—Karl F. Ross

[57] ABSTRACT

A wet and air-permeable fibrous web, such as a cellulosic sheet coming from a paper mill, is dried by being led around a rotating drum with peripheral interstices centered on a perforated suction tube. The latter opens into a low-pressure chamber inside a stationary sectorial shield which has a wall, facing against the direction of drum rotation, provided with one or more apertures for the moisture-laden air to be exhausted. The peripheral interstices are formed by strips lying between a pair of axially spaced end rings, these strips intersecting a plane transverse to the axis of rotation along lines whose distance from that axis increases progressively in the direction of rotation whereby air drawn through the web by suction is also mechanically accelerated, against the centrifugal force, toward the center of the drum.

5 Claims, 5 Drawing Figures

APPARATUS FOR DRYING A FIBROUS WEB

FIELD OF THE INVENTION

My present invention relates to an apparatus for drying a wet, air-permeable web, e.g. a cellulosic sheet coming from a paper mill or a mat of compacted textile or synthetic fibers.

BACKGROUND OF THE INVENTION

It is known to lead a web of this nature around a rotating drum having a perforated peripheral wall through which drying air, possibly preheated, can be aspirated with the aid of a perforated exhaust pipe extending along the drum axis. The suction created along the drum periphery, aside from assisting in the penetration of the web, also helps hold the web in contact with the drum throughout the drying area. In order to facilitate the detachment of the partly or fully dried web from the drum periphery, it is further known to provide a stationary shield which hugs the inner surface of the drum wall along a zone of limited arc length to cut off the air flow through the interstices of this wall; see, for example, U.S. Pat. No. 3,112,054.

Since suction is generally applied to the exhaust pipe at one end only, the pressure differential across the peripheral drum wall varies along the axis. This results, especially with drums designed to accommodate wide webs, in a nonuniformity of the drying process along the web surface. For a more efficient mode of operation, moreover, a progressive intensification of this pressure differential in the direction of travel may be desirable.

OBJECTS OF THE INVENTION

An important object of my present invention, therefore, is to provide means in a drying apparatus of the general type referred to for increasing the uniformity and efficiency of the aspirated air flow.

Another object is to provide an improved drum construction designed, especially with higher rotary speeds, to compensate for the resistance to the inward air flow resulting from centrifugal forces.

SUMMARY OF THE INVENTION

In accordance with my present invention, a stationary shield serving to obstruct the interstices of the peripheral drum wall over a zone of limited arc length comprises a casing, preferably of generally sectoral outline, extending from the exhaust pipe within the drum to the inner surface of its peripheral wall, which forms a low-pressure chamber communicating on the one hand with the exhaust pipe and on the other hand, through an entrance aperture provided in a side of the casing facing in the direction of drum rotation, with the interior of the drum. The air aspirated through the interstices of the nonobstructed area of the drum periphery, and through the web in contact with that area, thus passes through the entrance aperture into the low-pressure chamber and thence through the exhaust pipe to a source of suction such as a blower. The partial vacuum existing in this low-pressure chamber is substantially uniform over its axial length and, via the suitably dimensioned entrance aperture (or a set of such apertures), is distributed throughout the interior of the drum excluding the casing. The aspiration of the surrounding air is, of course, most intense in the vicinity of the entrance aperture, thus in a region immediately preceeding the point of detachment of the web from the drum surface.

According to a more particular feature of my invention, the peripheral drum wall is formed by spaced-apart strips extending between two axially separated end rings. These strips, advantageously, intersect a plane transverse to the axis along lines whose distance from that axis increases progressively in the direction of rotation whereby air drawn through the web by suction is also mechanically accelerated as it traverses the interstices between the strips.

BRIEF DESCRIPTION OF THE DRAWING

The above and other features of my present invention will now be described in detail with reference to the accompanying drawing in which.

SPECIFIC DESCRIPTION

Figure 1:
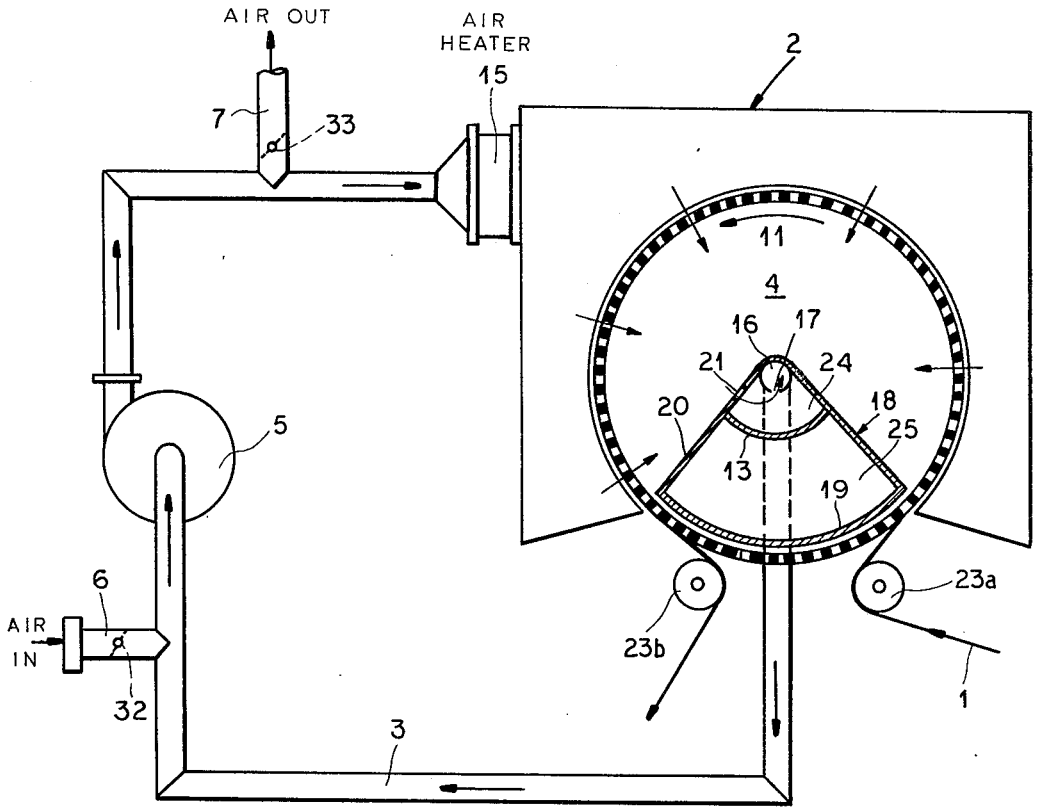
FIG. 1 is a somewhat diagrammatic view of a web-drying apparatus embodying my invention.

In FIG. 1 I have shown a drying apparatus for a fibrous web 1, e.g. a sheet of freshly manufactured paper, that is led around an inlet roller 23*a* into a housing 2 from which it exits around an outlet roller 23*b* after passing around a major portion of the periphery of a drum 4 rotating in a direction (here counterclockwise) indicated by an arrow 11. The drum is journaled on an exhaust pipe 16 extending along its axis, or mounted in cantilever fashion on a shaft aligned with that pipe, and has a perforated peripheral wall whose interstices are permeated by a radial flow of air. A minor portion of the peripheral drum wall, spanning the entrance and exit points defined by rollers 23*a* and 23*b*, is closely overlain along its inner surface by a bottom wall 19 of a sector-shaped casing 18 which enshrouds the pipe 16. A lateral wall 20 of the otherwise closed casing 18, facing against the direction of drum rotation, has an entrance aperture 21 through which air can pass via an opening 17 into pipe 16 for exhaustion via a conduit 3 extending to the intake port of a blower 5. Fresh air enters the conduit 3 through a branch pipe 6 upstream of blower 5 and mingles with the damp air extracted from drum 4. Part of the air mixture is continuously discharged via a branch pipe 7 downstream of blower 5; the remainder re-enters the housing 2 by way of an air heater 15. Branch pipes 6 and 7 are shown provided with respective valves 32 and 33 for adjusting the air circulation.

Figure 2:
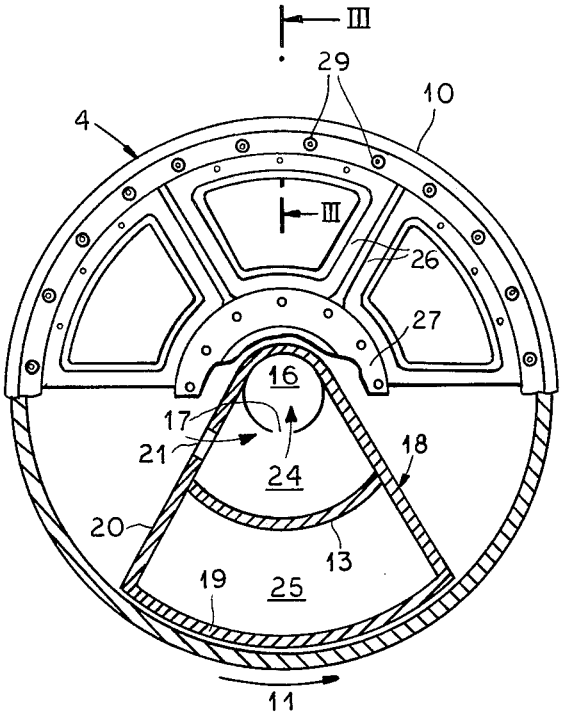
FIG. 2 is a partly cross-sectional end view of a drum included in the apparatus of FIG. 1.

Casing 18, shown in greater detail in FIG. 2, has an arcuate partition 13 subdiving its interior into an inner compartment 24 adjoining pipe 16 and an outer compartment 25 close to the peripheral drum wall. Compartment 25 plays no part in the drying operation since entrance aperture 21 opens only into compartment 24 which acts as a low-pressure chamber of suitably reduced volume.

Figure 4:
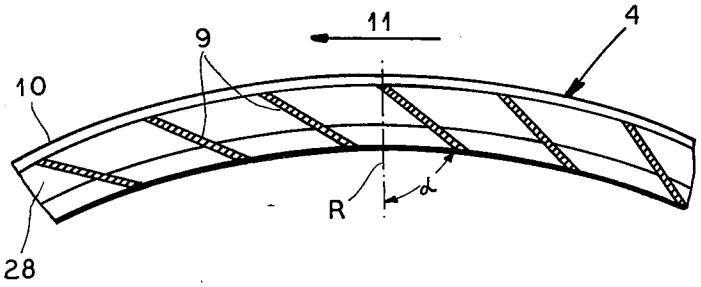
FIG. 4 is a fragmentary sectional view taken on the line IV—IV of FIG. 3.
Figure 3:
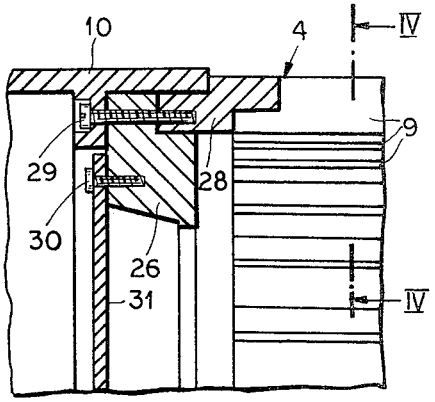
FIG. 3 is a fragmentary sectional view, drawn to a larger scale, taken on the line III—III of FIG. 2.

In FIGS. 2–4 the peripheral drum wall is shown to be formed by a multiplicity of strips 9 which extend between two end rings 28 (only one shown) that are secured to a pair of larger reinforcing rings 10 by a set of bolts 29 also traversing a set of supporting frames 26. The latter connect the rings 10 and 28 with a mounting sleeve 27 which could be part of a journal bearing carried on pipe 16 or a hub keyed to a drive shaft aligned therewith. The frames 26 are spanned by cover plates 31 (omitted in FIG. 2) that are secured thereto by screws 30.

The elements just described, shown in FIG. 3 only for the left-hand end of the drum, are duplicated substantially symmetrically at its right-hand end. The strips 9, made preferably of metal, account for the major portion of the axial width of the drum 4 and define a path for the web 1 (FIG. 1) bounded by lateral shoulders which are formed by the edges of rings 10; they may be secured to the end rings 28 by welding or other suitable means.

The low-pressure compartment 24 of casing 18 substantially equalizes the applied suction over the effective axial width of the drum as defined by the length of strips 9. Entrance aperture 21 may be a slot or a set of holes extending or distributed over approximately that axial width.

As shown in FIG. 4, the strips 9 are flat blades parallel to the drum axis and inclined at an angle $\alpha$, preferably ranging between about 15° and 75°, to the largest radius R, i.e. to the line extending from that axis to the outer blade edge, the vertex of this angle pointing in the direction of rotation (arrow 11). The axially extending spaces between strips 9 further contribute to an equalization of the pressure differential over the width of the drum.

Figure 5:
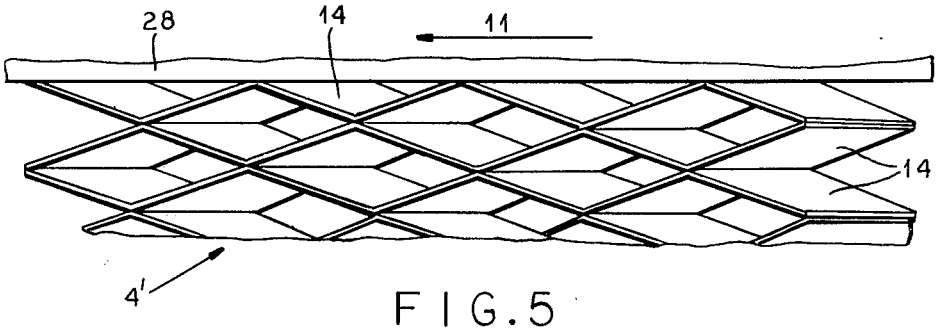
FIG. 5 is a fragmentary top view, also drawn to a larger scale, of a modified version of the drum shown in FIGS. 1 and 2.

In FIG. 5 I have shown a modified peripheral wall of a drum 4' in which strips 14 form a multiplicity of zig-zag-shaped bands, illustrated only in part, which encircle the drum axis and contact one another along lines inclined to the radial direction, and thus also to lines tangent to the drum periphery, at acute angles preferably ranging again between about 15° and 75°, as described for the blades 9 of FIG. 4.

These bands complement one another to a wide-mesh grid, particularly suitable for the support of thin paper sheets or the like, with rhomboidal interstices between their lines of contact. With either type of strip configuration, rotation of the drum accelerates the inward flow of drying air aspirated by the suction applied to exhaust pipe 16. This centripetal acceleration, of course, increases with the drum velocity and thus counteracts the centrifugal forces which are also a function of that velocity and tend to oppose the influx of air. The blades, moreover, help entrain the moisture-laden air in the direction of rotation toward aperture 17 of FIGS. 1 and 2.

I claim:

1. An apparatus for drying a wet air-permeable web, comprising:

a drum rotatable about an axis and provided with a peripheral wall having a multiplicity of interstices;

an exhaust pipe extending along said axis;

a substantially sector-shaped stationary casing extending from said exhaust pipe within said drum to the inner surface of said peripheral wall and forming a shield obstructing said interstices along a zone of limited arc length, said casing forming a low-pressure chamber communicating with the interior of said drum through at least one entrance aperture provided in a side of said casing facing against the direction of drum rotation, said exhaust pipe communicating with the interior of said casing, said casing being internally subdivided into an outer compartment close to said peripheral wall and an inner compartment adjoining said exhaust pipe, said entrance aperture opening only into said inner compartment;

external guide means for leading a web to be dried into contact with the outer surface of said peripheral wall near one end of said zone and detaching the web from said outer surface near the opposite end of said zone; and suction means connected to said exhaust pipe for drawing a flow of drying air through said web, said interstices and said entrance aperture.

2. An apparatus as defined in claim 1 wherein said peripheral wall is formed by spaced-apart strips extending between two axially separated end rings.

3. An apparatus as defined in claim 2 wherein said strips intersect a plane transverse to said axis along lines whose distance from said axis increases progressively in the direction of rotation.

4. An apparatus as defined in claim 3 wherein said strips extend substantially parallel to said axis.

5. An apparatus as defined in claim 3 wherein said strips form a plurality of zig-zag-shaped bands encircling said axis and complementing one another to a wide-mesh grid.

* * * * *